United States Patent [19]

Smith

[11] 4,261,743

[45] Apr. 14, 1981

[54] PYROMETALURGICAL SMELTING OF LEAD AND COPPER

[75] Inventor: Maurice R. Smith, Bristol, England

[73] Assignees: Metallurgical Processes Limited; I.S.C. Smelting Limited, both of Nassau, The Bahamas

[21] Appl. No.: 39,761

[22] Filed: May 17, 1979

[30] Foreign Application Priority Data

May 31, 1978 [GB] United Kingdom ..... 24714/78

[51] Int. Cl.[3] ..... C22C 9/08

[52] U.S. Cl. ..... 75/166 E; 75/72; 75/77

[58] Field of Search ..... 75/77, 78, 72, 166 E

[56] References Cited

U.S. PATENT DOCUMENTS

| | | | |
|---|---|---|---|
| 3,482,965 | 12/1969 | Milner | 75/78 |
| 3,666,441 | 5/1972 | Milner | 75/78 |

*Primary Examiner*—M. J. Andrews

*Attorney, Agent, or Firm*—Holman & Stern

[57] ABSTRACT

A method of smelting an oxide charge containing lead and copper in a blast furnace, wherein molten lead bullion flowing to the furnace bottom and containing at least 8% by weight of copper is diluted with metallic lead of lower copper content in the furnace shaft, or in the hearth at the bottom of the furnace, or in a forehearth into which furnace products are passed from the furnace, or in a transfer ladle into which lead bullion passes from the forehearth.

5 Claims, 1 Drawing Figure

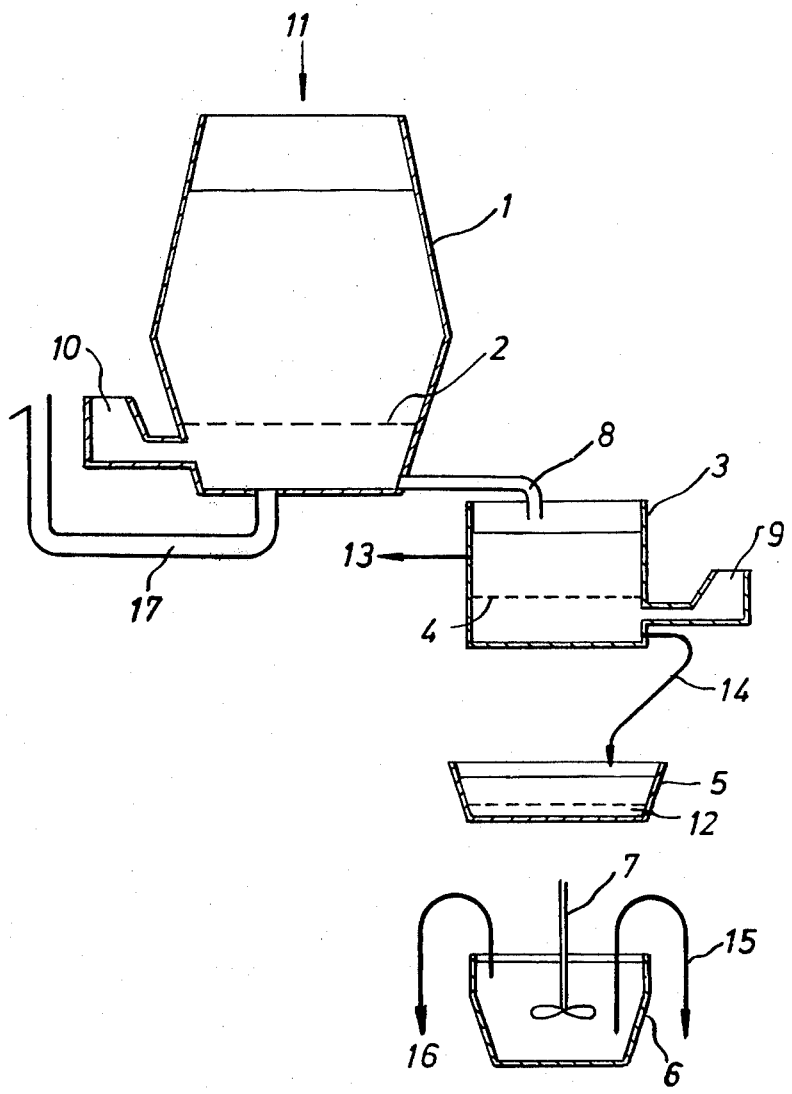
11
1
10
2
8
3
9
13
17
4
14
5
12
7
15
16
6

PYROMETALURGICAL SMELTING OF LEAD AND COPPER

This invention relates to the pyrometallurgical smelting of lead and copper from oxidic lead materials, and more specifically to the blast furnace smelting of oxidic plumbiferous materials containing an appreciable content of copper.

The smelting of oxidic lead materials in a blast furnace is well known. The charge to such a furnace usually contains lead oxides, with or without zinc oxide, and a number of minor metals in oxide form, together with a carbonaceous reducing agent. The most important among the minor metals is usually copper. The molten lead running to the bottom of the blast furnace usually contains such minor metals in the form of a solution or suspension of metallic or matte phases in the molten lead. Molten lead flowing to the bottom of a lead-smelting blast furnace is normally tapped, together with slag, into a forehearth in which phase separation between slag and bullion occurs. The lower layer (bullion) is then run into a transfer ladle to be taken to a so-called copper-drossing kettle. Alternatively the bullion is removed from the bottom of the blast furnace through a lead syphon separate from the slag tapping hole. Traditionally the copper has been separated from the lead by cooling the molten bullion, after it has been transported from the furnace to the drossing kettle, usually with stirring, so as to cause the copper to separate as an easily removable copper dross. In order to promote adequate stirring and to assist in producing a friable dross it is known to leave a heel of decopperized lead in the vessel in which drossing takes place, i.e. in the drossing kettle.

However, as the copper content of the furnace bullion increases copper dross begins to be precipitated at higher temperatures, and in any case at temperatures below about 950° C. a copper content of the bullion higher than about 7.5% by weight gives rise to accretion problems. Under these conditions the dross is no longer particulate and friable, but is massive and adheres to surfaces such as transfer ladles, stirrers and kettle walls. Further cooling merely serves to consolidate the masses produced. It has been shown that stirring the bullion in the transfer ladle, as it is tapped from the forehearth, will assist in maintaining ladle cleanliness at normal levels of copper in bullion (up to about 8%), as described in British Patent Application No. 39228/77.

The present invention is concerned with attempting to overcome the difficulties associated with the pyrometallurgical smelting of oxidic lead charges containing more copper than is normally handleable by the techniques outlined above.

The present invention provides a method of smelting an oxidic charge containing lead and copper in a blast furnace, wherein molten lead bullion flowing to the furance bottom and containing at least 8% by weight of copper is diluted with metallic lead of lower copper content (1) in the furnace shaft, or (2) in the hearth at the bottom of the furnace, or (3) in a forehearth into which furnace products are passed from the furnace, or (4) in a transfer ladle into which lead bullion passes from the forehearth.

Preferably the metallic lead used for dilution is decopperized lead bullion, more preferably previously-decopperized lead bullion produced by the same or a similar blast furnace. By decopperized lead bullion there is meant lead containing approximately 1% by weight of copper or less.

Where the dilution is carried out in a transfer ladle this may be suitably achieved by charging a heel of substantially decopperized lead bullion into the ladle before the copper-rich bullion is passed into it.

Where diluting lead is added to the forehearth, decopperized lead bullion may be pumped or poured into the forehearth either through the normal slag inlet duct or through a side-wall, e.g. from a well built onto the side of the forehearth. This may be done before, during or after tapping of slag from the furnace, the overall objective being to reduce the copper content of the bullion in the forehearth so as to prevent copper-rich material from forming an impervious crust on surfaces within the forehearth.

At higher levels of copper in charge, difficulties may arise earlier in the process flow scheme in that the quantity of lead bullion produced in the blast furnace may be insufficient to contain all the smelted copper in solution long enough to allow removal from the furnace and handling in the forehearth. In this case decopperized lead bullion may be added to the furnace shaft, in either solid or liquid form, and at a suitable level above or in the charge height. Liquid lead bullion may be added through a well built onto the outside of the furnace, preferably built onto the outside of the furnace hearth and connecting with the hearth crucible. Where solid lead is added to the furnace charge this should normally be done through a charging device separate from the normal charge hopper.

By the addition of metallic lead to the furnace shaft, furnace hearth, forehearth or transfer ladle in the manner described according to the invention, it is possible to maintain the copper content of lead bullion at a level which allows handling of the lead bullion at all points in the flow scheme without problems occurring due to the solidification of copper-rich phases on working parts of the equipment.

The invention will be further described, by way of example only, with reference to the accompanying drawing, which is a schematic diagram illustrating a blast furnace and associated forehearth, transfer ladle and drossing kettle, and showing the various points at which diluting lead may be added.

The drawing shows a blast furnace 1 for the smelting of oxidic lead materials. Molten lead formed in the blast furnace shaft runs to the hearth at the bottom of the furnace (below the broken line 2) and contains minor metals, including copper, as a solution or suspension of metallic or matte phases in the molten lead. Molten lead flowing to the bottom of the furnace is tapped, together with slag, into a forehearth 3 in which phase separation between slag and lead bullion occurs. The lower layer (bullion), below the broken line 4, is then run into a transfer ladle 5 to be taken to a copper-drossing kettle 6 having a stirrer 7.

According to the present invention, the molten copper-containing lead bullion is diluted with metallic lead of lower copper content either in the furnace 1, or in the forehearth 3, or in the transfer ladle 5.

Where the diluting lead is added to the forehearth 3, decopperized lead bullion may be pumped or poured into the forehearth either through the normal slag inlet duct 8 or through a side wall, for example from a well 9 built onto the side of the forehearth.

If decopperized lead bullion is to be added to the furnace shaft, in either solid or liquid form, this may be done at any suitable level above or in the charge height. Liquid bullion may be added through a well 10 built onto the outside of the furnace hearth and connecting with the hearth crucible. Where solid lead is added to the furnace, this should normally be done through a charging device 11 separate from the normal charge hopper.

Where the dilution is carried out in the transfer ladle 5, this is preferably achieved by charging a heel 12 of substantially decopperized lead bullion into the ladle before the copper-rich bullion is tapped into it.

In the drawing arrow 13 indicates the discharge of slag from the foreheath 3, arrow 14 indicates copper-rich lead bullion tapped from the forehearth 3 into the transfer ladle 5, arrow 15 indicates decopperized lead removed from the drossing kettle by pumping lead from the kettle into a suitable casting mould or further refining equipment, and arrow 16 indicates copper dross removed by suction or otherwise for subsequent copper recovery, usually by leaching.

Many lead blast furnaces operate a lead syphon system 17 for the removal of lead from the furnace hearth, thus avoiding the use of a forehearth. The lead syphon is even more susceptible to problems resulting from the premature formation of copper dross than a forehearth and is therefore unable to handle high levels of copper in furnace bullion. To avoid such problems, decopperized lead bullion may be added to the furnace in solid form above the charge level, although such lead bullion could possibly be added in either solid or liquid form anywhere in the furnace shaft or even as liquid lead to the furnace hearth.

It will be understood that lead can be recirculated to the blast furnace with a minimal effect on the furnace heat balance. Thus, if solid lead is added to the furnace shaft above the charge level, the added lead is raised to the normal lead tapping temperature of 1100° C. within the furnace shaft, requiring up to $41.6\times10^3$k cal of heat per tonne of added lead. This heat is obtained from the combustion of 0.007 tonnes of carbon (per tonne of added lead). The lead may be added in the liquid state, in which case the amount of heat required would be reduced by $20\times10^3$k cal per tonne of added lead (at 500° C.).

In the case of adding lead at the furnace bottom, the extra quantity of lead to be held in the furnace hearth would raise the level of the hearth products closer to the noses of the tuyeres of the blast furnace and increase the rate of heat transfer between the tuyere gas and the molten hearth products, as is shown in the paper "Heat and mass transfer in the tuyere region of a zinc-lead blast furnace: model studies", by M. W. Gammon, published in "Advances in extractive metallurgy", 1977, The Institution of Mining and Metallurgy. It is demonstrated that the heat transfer will be more than doubled by raising the level of the molten furnace hearth products by 70 mm to tuyere level. This additional heat input will be sufficient to raise the lead to the normal tapping temperature.

The quantities of added lead required for different furnace copper loadings are indicated in the following table:

| | | | | |
|---|---|---|---|---|
| Natural copper content of furnace lead bullion | 15% | 20% | 25% | 30% |
| Amount of decopperized lead required to reduce the copper content of the furnace lead bullion to | | | | |
| (i) 7.5% by weight Cu (per) ton of natural bullion), | 1.00t | 1.67t | 2.33t | 3.00t |
| (ii) to 6.0% by weight Cu | 1.50t | 2.33t | 3.17t | 4.00t |

For the purpose of the above calculation the diluting lead was assumed to have a zero copper content, although it would in practice have a content of at least 0.1–0.2% by weight copper.

I claim:

1. A method of smelting an oxidic charge containing lead and copper in a blast furnace, comprising diluting molten lead bullion flowing to the furnace bottom and containing at least 8% by weight of copper with metallic lead of lower copper content, said dilution being effected in the furnace shaft.

2. The method according to claim 1, comprising adding solid decopperized lead bullion to the furnace shaft above the charge level therein through a charging device separate from the charge hopper.

3. The method according to claim 1, comprising adding liquid decopperized lead bullion to the furnace through a well built onto the outside of the furnace.

4. A method of smelting an oxidic charge containing lead and copper in a blast furnace, comprising diluting molten lead bullion flowing to the furnace bottom and containing at least 8% by weight of copper with metallic lead of lower copper content, said dilution being effected in the hearth at the bottom of the furnace.

5. The method according to claim 4, comprising adding liquid decopperized lead bullion to the furnace hearth through a well built onto the outside of the furnace hearth.

* * * * *